United States Patent [19]

Prasad

[11] Patent Number: 4,809,764

[45] Date of Patent: Mar. 7, 1989

[54] METHOD OF CASTING A METAL ARTICLE

[75] Inventor: T. V. Rama Prasad, Mentor, Ohio

[73] Assignee: PCC Airfoils, Inc., Cleveland, Ohio

[21] Appl. No.: 174,007

[22] Filed: Mar. 28, 1988

[51] Int. Cl.[4] ..... B22D 27/04

[52] U.S. Cl. ..... 164/122.1; 164/125; 164/127

[58] Field of Search ..... 164/122, 122.1, 122.2, 164/125, 127, 338.1, 349, 348, 350, 352, 361, 359

[56] References Cited

U.S. PATENT DOCUMENTS

| | | | |
|---|---|---|---|
| 3,342,455 | 9/1967 | Fleck et al. | 164/125 |
| 3,376,915 | 4/1968 | Chandley | 164/125 |
| 3,405,220 | 10/1968 | Barrow et al. | 164/127 |
| 3,465,812 | 9/1969 | Dieters et al. | 164/338.1 |
| 4,609,029 | 9/1986 | Vishnevsky | 164/122.1 |
| 4,724,891 | 2/1988 | Brookes | 164/122.1 |

*Primary Examiner*—Richard K. Seidel

*Attorney, Agent, or Firm*—Tarolli, Sundheim & Covell

[57] ABSTRACT

A long, thin article or portion of an article of an equiaxed metal is cast without providing gates along the length of a portion of a mold cavity in which the long thin portion of the article is cast. Prior to casting the article, the lower half of the long thin portion of the article mold is heated into a temperature range in which the highest temperature is close to but less than the solidus temperature of the metal of the article. Molten metal is conducted into the long thin portion of the article mold cavity at a location other than along the length of the long thin portion of the article mold cavity. During solidification of the molten metal, molten metal is simultaneously solidified along surface areas in the lower half of the long thin portion of the mold cavity and along surface areas in the upper half of the long thin portion of the mold cavity. The solidificaton of the molten metal in the lower half of the long thin portion of the mold cavity is completed prior to completion of solidification of the molten metal in the upper half of the long thin portion of the mold cavity.

15 Claims, 3 Drawing Sheets

METHOD OF CASTING A METAL ARTICLE

The present invention relates to a method of casting a metal article and more specifically to a method of casting a metal article which is relatively long and thin or which has a portion which is long and thin and has an equiaxed grain structure.

When a long thin metal article with an equiaxed grain structure is to be cast, it is a common practice to provide gating at various locations along the length of the mold cavity. This gating conducts feed metal which compensates for shrinkage of the metal during solidification. The number of gates depends upon the relationship between the length of the article being cast and the thickness of the article. It has been a common practice to provide gates which are spaced apart along the length of an article mold by a distance of between 3 to 12 times the thickness of the article being cast.

The use of gates promotes the formation of defects in castings. Thus, hot tears and/or distortion tends to occur in the article where a gate is connected with the article. In addition a stub usually remains at location away of the stub is relatively difficult when the surface of the article has a curved configuration. Another disadvantage associated with the use of gates is that an area of distinctly larger grain size is formed in the area where the gate was connected with the article.

Long thin articles have previously been cast with a directionally solidified or columnar grained crystalographic structure. When this is done, the mold is preheated to a relatively high temperature which is substantially above the liquidus temperature of the metal of which the cast article is to be formed. Super heated molten metal is then poured into the preheated mold. Heat is supplied to the mold during pouring so that the metal remains molten during and immediately after pouring.

After the mold has been filled with molten metal, the molten metal is solidified upwardly in the article mold cavity along a horizontal front. Thus, the molten metal is solidified from the bottom of the mold upwardly to an upper end of the mold along a generally horizontal interface or front to prevent the formation of shrinkage voids. The solidification of the molten metal in this manner with a columnar grained crystalographic structure is promoted by withdrawing the mold downwardly from a furnace.

The casting of thin articles is described is U.S. patent application Ser. No. 813,247, now U.S. Pat. No. 4,724,891, filed Dec. 24, 1985 by Ronald R. Brookes and entitled Thin Wall Casting. A general method of directionally solidifying a casting is described in U.S. Pat. No. 4,609,029.

SUMMARY OF THE INVENTION

The present invention relates to a new and improved method of casting a metal article which is long and thin or which has a long thin portion and an equiaxed grain structure. The article is cast in a mold cavity having a configuration corresponding to the configuration of the article. The article mold cavity is free of gating and risers between opposite ends of a long thin portion of the mold cavity. Thus, there are no gates or risers along the length of the long thin portion of the mold cavity.

The mold is preheated so that a lower half of the portion of the article mold in which the long thin portion of the article is cast is at a temperature which is close to but less than the solidus temperature of the metal of the article. The upper half of the portion of the article mold in which the long thin portion of the article is cast may be heated to a temperature which is either somewhat above or below the solidus temperature of the metal of the article to cavity through an inlet from a gate or runner at the upper end of the article mold cavity. If desired, a second gate or a riser could be connected with the lower end of the article mold cavity.

During and immediately after pouring, the molten metal is simultaneously solidified along at least fifty percent of the surface area of the lower half of the portion of the article mold cavity in which the long thin portion of the article is cast and along at least fifty percent of the surface area of the upper half of the portion of the article mold cavity in which the long thin portion of the article is cast. The molten metal in the lower half of the portion of the article mold cavity in which the long thin portion of the article is cast is completely solidified before the molten metal in the upper half of this portion of article mold cavity is completely solidified. During solidification of the molten metal with an equiaxed grain structure, shrinkage is compensated for by feeding metal to the long thin portion of the article mold cavity through the inlet at which molten metal was originally conducted to the long thin portion of the article mold cavity.

Accordingly, it is an object of this invention to provide and improved method of casting a relatively long thin article, or an article having a long thin portion, with an equiaxed structure providing gates at locations along the length of a long thin portion of the article mold cavity.

Another object of this invention is to provide a new and improved method as set forth in the preceding object and wherein molten metal is simultaneously solidified along at least fifty percent of the surface area of a lower half of the long thin portion of the article mold cavity and along at least fifty percent of the surface area of an upper half of the long thin portion of the article mold cavity.

Another object of this invention is to provide a new and improved method as set forth in either of the preceding objects and wherein the lower half of the long thin portion of the article mold is preheated into a range of temperatures in which the highest temperature is close to but less than the solidus temperature of the metal to be cast.

BRIEF DESCRIPTION OF THE DRAWINGS

The foregoing and other objects and features of the present invention will become more apparent upon a consideration of the following description taken in combination with the accompanying drawings wherein.

DESCRIPTION OF SPECIFIC PREFERRED EMBODIMENTS OF THE INVENTION

Metal Article

Figure 1:
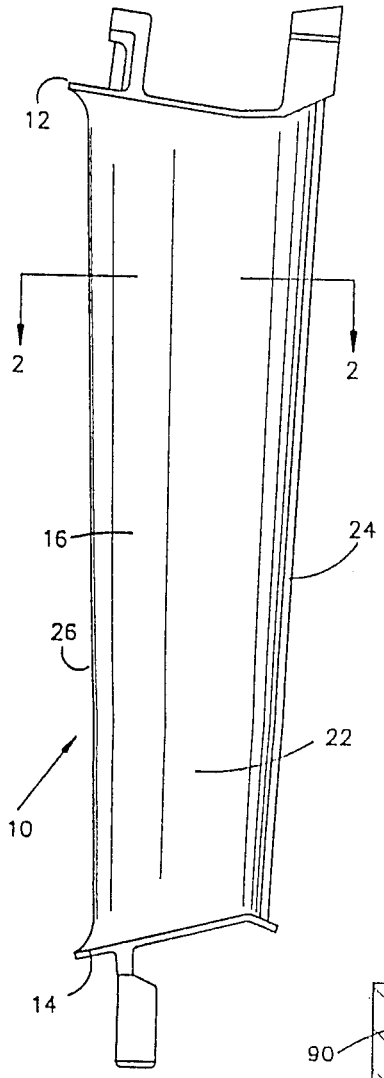
FIG. 1 is an elevational view of a metal article having a long thin airfoil portion which is cast with the method of the present invention.

A metal article 10 having a long thin portion and cast with the method of the present invention, is illustrated in FIG. 1. Although the present invention could be utilized to cast many different articles, the article 10 is a vane for use in a jet engine. Due to the relatively severe operating conditions to which the vane 10 is exposed, it is formed of a nickel chrome superalloy. The vane 10 has an equiaxed grain structure.

The vane or metal article 10 has an upper shroud portion 12 and a lower shroud portion 14. A long thin airfoil portion 16 extends between and is cast as one piece with the upper and lower shroud portions. The vane 10 has a length of approximately 8.25 inches. The airfoil portion 16 of the vane 10 has a length of approximately seven inches.

The airfoil portions 16 of the vane 10 has a width of approximately 2.5 inches. Thus, the distance between the leading edge portion 24 (FIG. 2) of the vane 10 and a trailing edge portion 26 of the vane, as measured along a central axis 28, is approximately 2.5 inches. Since the airfoil portion 16 of the vane 10 has a slight longitudinal taper, the distance between the leading and trailing edge portions 24 and 26 varies along the length of the vane 10. The airfoil portion 16 of the vane 10 has a maximum thickness of approximately 0.080 inches. The airfoil portion 16 of the vane 10 gets thinner toward the leading and trailing edge portions 24 and 26.

The generally rectangular shroud sections 12 and 14 of the one piece vane 10 are substantially thicker than the airfoil portion 16. Thus, the shroud sections 12 and 14 have a width of approximately an inch and a half and a height of approximately five eigths of an inch. It should be understood that the vane 10 could have a configuration other than the specific configuration illustrated in FIGS. 1 and 2. For example, one or both shroud sections 12 and 14 could be omitted if desired. Although the vane 10 is formed of a nickel chrome superalloy, it is contemplated that blades, vanes or other articles cast in accordance with the method of the present invention be formed of different metals. For example, articles which are long and thin or have portions which are long and thin may be cast of cobalt based alloys or iron based alloys. However, it is believed that the present invention will be particularly advantageous in the casting of nickel chrome superalloy blades and vanes.

The airfoil portion 16 of the vane 10 is a long thin article. Thus, the airfoil portion 16 of the vane 10 has a length (FIG. 1) of more than four inches. The length of the airfoil portion 16 of the vane 10 is also at least twenty times the thickness of the airfoil portion. Therefore, the airfoil portion 16 of the vane 10 meets the requirements for what is referred to herein as a long thin article. The specific vane 10 illustrated in FIGS. 1 and 2 has an airfoil portion 16 with a length which is approximately eighty-seven times the thickness of the airfoil portion.

Figure 3:
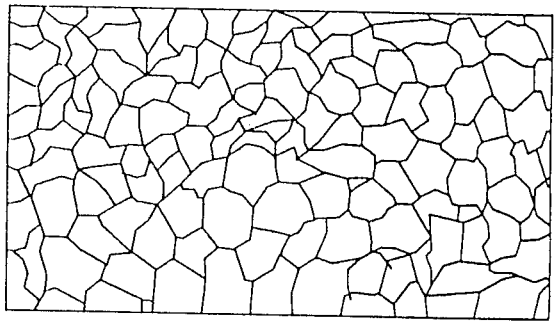
FIG. 3 is a greatly enlarged view illustrating equiaxed grains of the cast article of FIGS. 1 and 2.

The vane 10 has an equiaxed grain structure which is illustrated in FIG. 3. Thus, the vane 10 has numerous randomly orientated grains which are the result of random nucleation and grain growth during solidification of the molten metal forming the vane 10. The surface grains have a maximum dimension of one half of an inch or less. Although long thin blades and/or vanes have been formed with columnar grain structure or as a single crystal conditions at certain locations in a jet engine are such as to make the use of an equiaxed grain structure the most economical.

Casting The Article

When casting an equiaxed metal article which is relatively long and thin or which has a portion which is long and thin, that is an article or a portion of an article having a length which is more than four inches and which is at least twenty times its thickness, it is customary to provide gates or passages at a plurality of locations along the length of the article. The customary gates or passages conduct molten metal to the long thin portion of the mold cavity during filling of the mold cavity with molten metal. The gates or passages also conduct molten metal to the long thin portion of the mold cavity to compensate for shrinkage of the metal as it solidifies.

Figure 2:
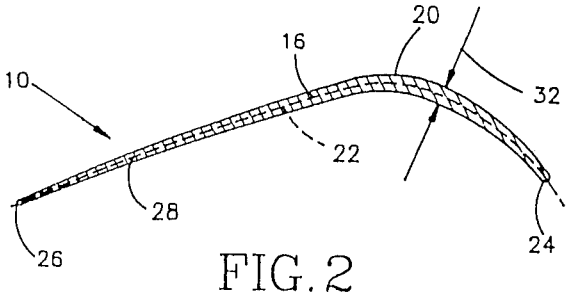
FIG. 2 is a sectional view, taken generally along the line 2—2 of FIG. 1, illustrating the configuration of the airfoil portion of the metal article.

When conventional casting practices were used in an attempt to cast a vane similar to the vane 10 of FIGS. 1 and 2, four gates were used. The gates were spaced apart along the convex side of the long thin portion of the mold cavity in which the airfoil portion 16 was to be cast. This particular vane had a long thin airfoil portion with a length of 11 inches and a maximum thickness of 0.120 inches. Of course, the number of gates which conventional practice indicates should be used will vary depending upon the type of mold, the metal being cast, and many other factors.

The use of a relatively large number of gates during the casting of a long thin article of equiaxed metal, such as the vane 10, substantially increases the cost of producing the article. The metal which solidifies in the gates is scrap which, in the case of expensive alloys, can contribute significantly to the cost of the article. In addition, the gates frequently result in casting defects, such as excessively large grains, hot tears and/or distortion.

When gates are connected with a curved surface in a mold, a stub end portion of the gate must be carefully ground away. The grinding must be carefully performed in order to provide the cast article with a continuous surface having the desired curvature. Thus, the grinding away of gate stubs from major side surfaces 20 and 22 of the airfoil 10 would be a laborious and time consuming process.

In accordance with a feature of the present invention, no gates were used along the length of the long thin portion of the mold cavity in which the vane 10 of FIGS. 1 and 2 was cast with an equiaxed grain structure. Thus, an article mold 38 (FIG. 4) having only a single inlet at its upper end was used to cast the vane 10. There are no gates along the sides of the article mold 38. However, it is contemplated that a blind riser or a gate could be provided at the lower end of the article mold if desired. The casting process was conducted in such a manner as to result in the vane 10 having a fine equiaxed grain structure, similar to the grain structure shown in FIG. 3. The vane 10 was free of shrinkage defects, hot tears and distortion.

For reasons of economy, it is preferred to cast a plurality of the vanes at a time. Therefore, a one piece mold structure 42 is used to cast a plurality of the vanes at a time. The mold structure 42 includes a circular array of twelve article molds 38. It should be understood that although only two article molds 38 have been shown in FIG. 4, the mold structure 42 may have eight, twelve, sixteen, or more article molds 38 disposed in an annular array or cluster about a solid support post 44.

A pour cup 46 is supported on an upper end of the support post 44. A plurality of gates or runners 48 extend outwardly from the pour cup 46 with one runner going to each article mold 38. The article molds 38 are supported on a circular base plate 52 by ceramic spacer blocks 54 having a height of three eights to one and one half inches. The spacer blocks 54 support the closed lower end portions of the article molds 38. The spacer blocks could be eliminated or could have different dimensions if desired.

When the mold structure 42 is to be made, a wax is assembled. The wax pattern includes a plurality of article patterns having the same configuration as the configuration of the article to be cast, that is the same configuration as the vane 10. The article patterns did not have any gate patterns disposed along the length of the article patterns.

The wax patterns of the articles, that is, the vanes 10, are connected with wax patterns having a configuration corresponding to passages in the gates or runners 48. There is only one gate or runner passage pattern connected to the upper end of each vane pattern. The runner passage patterns are in turn connected with a pattern corresponding to the shape of the inside of the hollow pour cup 46. A ceramic spacer block 54 is connected with a lower end of each vane pattern. A ceramic support post extends between the pour cup pattern and a wax pattern of the base plate 52.

The entire pattern assembly is repetitively dipped in a slurry of ceramic mold material and stuccoed to build up a layer of mold material over the pattern assembly. Once a layer of desired thickness has been built up over the pattern assembly the layer is dried. The wax pattern material is then melted and removed from the ceramic layer by the use of heat and/or chemical solutions. The ceramic mold material then fired to give it the requisite strength and complete the process of forming the mold structure 42.

The process of making a mold structure similar to the mold structure 42 by the foregoing process is well known. However, it should be noted that the wax pattern and the resulting mold structure does not have any provision for gating passages to side portions of the article molds 38. The only passages for conducting molten metal to the article molds 38 from the pour cup 46 are in the runners 48.

When vanes or articles 10 are to be cast, the mold structure 42 is placed on a circular water cooled copper chill plate 60. Although the closed lower ends of the article molds are close to the chill plate 60, they are separated from the chill plate by three eights to one and one half inches of ceramic material. The longitudinal central axes of article mold cavities in the article molds 38 are perpendicular to a horizontal upper side surface 62 of the chill plate 60.

A motor (not shown) then moves a cylindrical support post 64 for the chill plate 60 vertically upwardly. As the chill plate 60 moves upwardly the mold structure 42 enters a chamber or housing (not shown) which encloses a furnace 68. Continued upward movement of the chill plate 60 moves the mold structure 42 into a cylindrical furnace chamber 72. The housing enclosing the furnace 68 is then evacuated and the mold structure 42 preheated.

The furnace preheats the mold structure 42 in a nonuniform manner. Thus, there is a temperature gradient which increases from a low temperature at the lower end of the article molds 38 to a higher temperature at the upper ends of the molds. An imaginary horizontal plane 76 extends through the centers of the long thin portions of the article molds 38 and divides the long thin portions of the article molds into a lower half 82 and an upper half 84.

The lower half 82 of the long thin portions of each of the article molds 38 is heated into a first temperature range. The highest temperature in this first temperature range is close to but is less than the solidus temperature of the metal of the vane 10. The upper half of the long thin portions of each of the article molds 38 is heated into a second temperature range. The second temperature range contains temperatures which are higher than the temperatures in the first temperature range. Since the upper and lower halves 82 and 84 of the long thin portions of the article molds 38 are separated by only an imaginary plane 76 the lowest temperature in the second temperature range into which the upper half 84 is heated is the same as the highest temperature of the temperature range into which the lower half 82 is heated.

The highest temperature of the second temperature range into which the upper half 84 of a long thin portion of an article mold 38 is heated is close to the solidus temperature of the molten metal of the vane 10. The highest temperature to which the upper half 84 of a long thin portion of an article mold 38 is heated may be somewhat greater than the solidus temperature of the metal of the vane 10 or somewhat less than the solidus temperature of the metal of the vane 10. Due to many different factors, the vertical temperature gradient along the mold 38 will probably not increase in exactly a uniform manner from the lower end of an article mold 38 to the upper end of the article mold. However, the temperature gradient will probably be similar to a uniform temperature gradient. It should be understood that the lower end of the article mold 38 is preheated to the lowest temperature and the upper end of the article mold is preheated to the highest temperature.

Preheating the lower half 82 to a temperature which is less than the temperature of upper half 84 is facilitated by having the mold structure 42 supported by the chill plate 60. In addition, helical coils 90, 92 and 94 are energized to different extends to further promote the desired temperature gradient. Thus, the amount of electrical energy which is conducted to the coil 90 is greater than the amount of electrical energy conducted to the coil 92. The amount of electrical energy conducted to the coil 92 is greater than the amount of electrical energy conducted to the coil 94. The differential energization of the coils 90–94 results in a differential in the heat energy transmitted through a graphite susceptor 96 to the article molds 38.

Although it is preferred to establish the temperature gradient between the upper and lower ends of the article molds 38 by the combined effect of the chill plate 60 and differential energization of the induction coils 90–94, the temperature gradient could be established by the use of baffles. Thus, a cylindrical baffle could be provided around the lower portion of the circular array of article molds 38. In addition, one or more annular baffles could extend radially inwardly from the cylindrical susceptor 96 to promote the establishment of a temperature gradient. Other baffle arrangements could be used if desired.

The coils 90, 92 and 94 are surrounded by a cylindrical furnace wall 98. An annular ceramic ring 100 is disposed adjacent to the lower end of the furnace wall 98. The susceptor 96 is seated on and supported by the ceramic ring 100. Of course, the furnace 68 could have a construction which is different than the specific construction shown in FIG. 4.

Regardless of how the temperature gradient is established, the upper end of a preheated article mold 38 is hotter than the lower end of the article mold. The temperature of the upper end of the long thin portion of a preheated article mold 38 is close to but may be either above or below the solidus temperature of the metal of the vane 10. The lower end of the long thin portion of the preheated article mold 38 is at a temperature which is approximately 50 to 500 degrees Fahrenheit less than the temperature of the upper end of the long thin portion of the article mold.

Once the article molds 38 have been preheated in the foregoing manner, molten metal is poured through an opening 102 in a circular upper end wall 104 of the furnace 68 into the pour cup 46. At the time of pouring, the molten metal is superheated by 50 to 400 degrees Fahrenheit. The pouring of the molten metal occurs in the vacuum chamber or housing which surrounds the furnace 68. Although it is preferred to fill the article mold cavity from only a single runner or gate 48 connected in fluid communication with the upper end of the article mold cavity, a second runner or gate could be connected with the lower end of the article mold cavity if desired.

Since seventy to one hundred percent of the length of each of the long thin portions of the article molds 38 is below the solidus temperature of the molten metal, random nucleation occurs over almost the entire surface of each article mold cavity when the molten metal is poured into the article molds. Although the exact extent of nucleation on the surfaces of the article mold cavities is not known, it is believed that nucleation and, therefore, initiation of solidification of the molten metal, occurs at locations which are disposed along at least the lower eighty to ninety percent of the long thin portion of each article mold cavity. This nucleation may be promoted by the presence of an inoculant in the molten metal.

As soon as the article molds 38 are filled with molten metal, withdrawal of the mold structure 42 from the furnace 68 begins. The rate of withdrawal of the mold structure 42 from the furnace 68 into the vacuum chamber surrounding the furnace is relatively high, that is 60 to 120 inches per hour. However, slower mold withdrawal speeds have also been used. Withdrawal of the mold assembly 42 from the furnace 68 is accomplished by lowering the chill plate 60 and its support post 64 at a constant speed. However, the speed of withdrawal of the mold structure 42 could be varied as the mold is withdrawn from the furnace.

Figure 5:
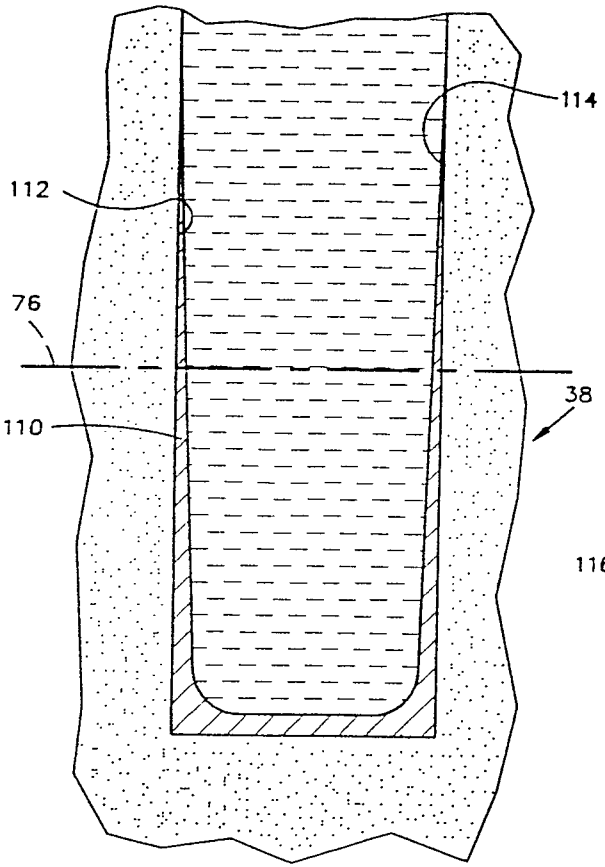
FIG. 5 is a schematicized sectional view of an article mold cavity of the mold structure of FIG. 4 and illustrating the manner in which molten metal initially solidifies along a large majority of the surface area of the long thin portion of the article mold cavity.

As an article mold 38 is withdrawn from the furnace 68, a thin, discontinuous layer or skin 110 (FIG. 5) of equiaxed metal solidifies over a large majority of an inner side surface 112 of the long thin portion of an article mold cavity 114. Although it can only be hypothesized, it is believed that the thin layer 110 extends over all but the upper two to ten percent of the inner side surface 112 of the long thin portion of the article mold cavity 114. The metal layer 110 has an equiaxed grain structure (FIG. 3) with a maximum grain dimension of one half of an inch or less. Of course, the inner side surface 112 of the long thin portion of the article mold cavity 114 and the metal layer 110 have a configuration which corresponds to the configuration of the long thin portion of the article to be cast, that is, the airfoil portion 16 of the vane 10.

As the mold structure 42 is withdrawn from the furnace 68 (FIG. 4) into the vacuum chamber, dendrites grow inwardly and upwardly from the thin skin 110 extending over the side surface 112 (FIG. 5) of the long thin portion of the mold cavity 114. However, the thin skin or layer 110 does not initially extend over the single inlet to the article mold cavity 114. Therefore, molten metal can be fed from a runner 48 into an article mold cavity 114.

The closed lower end portion of each article mold 38 is disposed adjacent to the chill plate 60. The lower end portion of each article mold 38 is lowered from the furnace 68 into the relatively cool vacuum chamber. Therefore, dendrites grow upwardly from the thin skin 110 at a faster rate than they grow inwardly from the thin skin 110.

As an article mold 38 is withdrawn from the furnace 68, molten metal solidifies faster in the lower half 82 of the long thin portion of the article mold than in the upper half 84 of the long thin portion article mold. This is due to the combined effect of: preheating the lower half 82 to a lower temperature than the upper half 84, having the closed lower end of the article mold adjacent to the chill plate 60, and withdrawing the lower end portion of the article mold 38 from the furnace 68 into the relatively cool environment of the vacuum chamber surrounding the furnace 68. Therefore, the molten metal in the article mold cavity 114 solidifies, with an equiaxed grain structure, upwardly from the bottom of the mold cavity at a greater rate than it solidifies inwardly from the upright sides of the article mold cavity.

Figure 6:
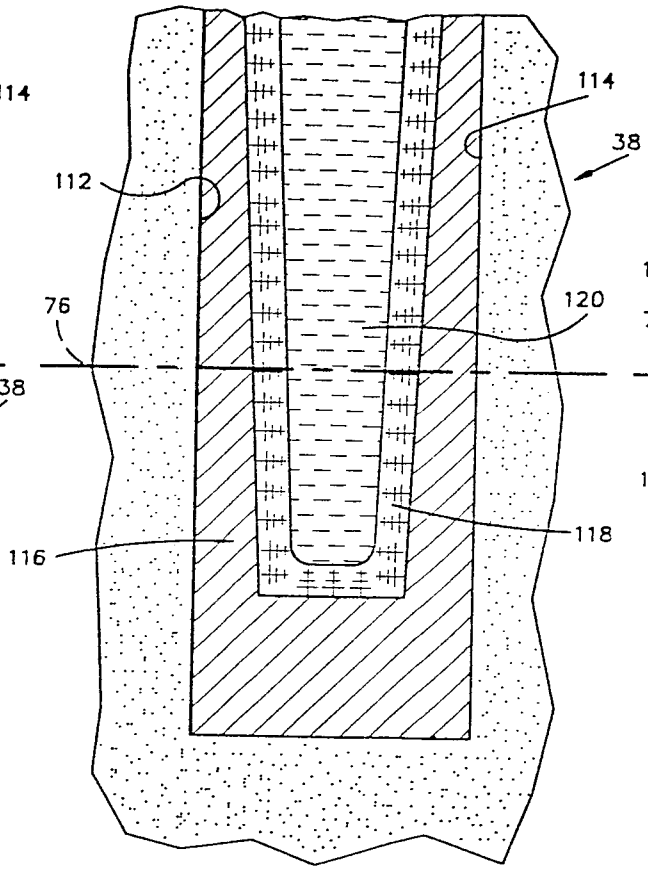
FIG. 6 is a schematic sectional view, generally similar to FIG. 5, illustrating the manner in which the molten metal simultaneously solidifies upwardly from the bottom of the long thin portion of the mold cavity and inwardly from the sides of the mold cavity.

As the molten metal solidifies in the long thin portion of the article mold cavity 114 (FIG. 6), a solid zone 116 is formed at the lower end and along the sides of the long thin portion of the article mold cavity. A mushy zone 118 (FIG. 6) of partially molten, partially solidified metal is located inwardly of the solid zone 116. A liquid zone 120 is located inwardly of the mushy zone 118 and is disposed along the central axis of the long thin portion of the article mold cavity 114. The liquid zone 120 extends upwardly to the opening to a runner or gate 48.

Figure 7:
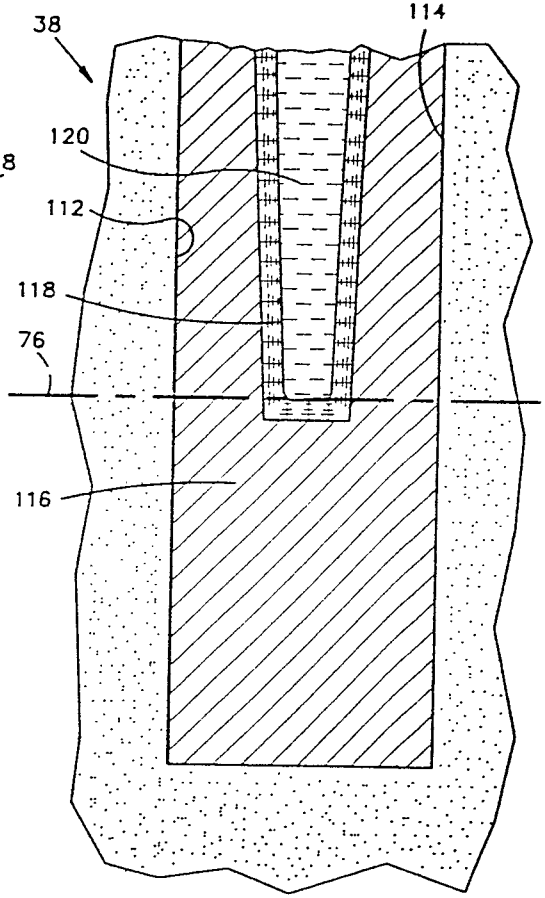
FIG. 7 is a schematic sectional view, generally similar to FIG. 6, illustrating the manner in which the molten metal solidifies in the lower portion of the long thin portion of the article mold cavity before the metal solidifies in the upper portion of the article mold cavity.

Although dendrites will extend from the thickening layer of solidified metal on the upright sides of the long thin portion of the article mold cavity 114 into the mushy zone 118, molten metal can be fed from a runner 48 into the mushy zone to compensate for shrinkage as the molten metal in the mold cavity 114 solidifies. As solidification continues, the size of the mushy zone 118 decreases (FIG. 7) and the amount of solidified molten metal in the lower half of the long thin portion of the article mold cavity 114 increases. Due the effect of the relatively cold chill plate 60, the relatively hot molten metal in the pour cup 46 and runner 48 and the temperature gradient established during preheating of the mold, the shrinking mushy zone 118 moves upwardly along the vertical longitudinal central axis of the long thin portion of the article mold cavity 114.

As the article mold 38 continues to be withdrawn from the furnace 68, the mushy zone 118 will move upwardly at a greater rate than it moves inwardly from the upright sides of the long thin portion of the article mold cavity 114. This enables the molten metal to solidify in the article mold cavity without the formation of voids or other defects. When solidification of the molten metal in the lower half of the long thin portion of the article mold cavity has been completed, the solidification of the molten metal in the upper half of the long thin portion of the article mold cavity will not have been completed. However, when solidification of the molten metal in the lower half of the long thin portion of the article mold cavity has been completed, the majority of the molten metal in the upper half of the long thin portion of the article mold cavity will have solidified. It is estimated that when solidification of the molten metal in the lower half of the long thin portion of the article mold cavity is completed, approximately seventy to eighty five percent of the molten metal in the upper half of the long thin portion of the article mold cavity will have solidified.

Solidification progresses from the lower end of the long thin portion of the article mold cavity 114 to the upper end of this portion of the mold cavity. The feeding of molten metal to compensate for shrinkage occurs along the central axis of the article as the metal solidifies. This technique controls solidification such that it keeps open a central channel 120 inside the solidified metal 116 through which molten metal can feed from top runners 48 to compensate for solidification contraction occurring in remote lower sections.

This technique also actively promotes the availability of transverse secondary interdendritic channels for required lateral feeding of solidifying sections. Transverse interdendritic feeding depends primarily on the length of the interdendritic channels, which are generally determined by the dimensions of the mushy zone 118. Since the width of the mushy zone 118 is inversely related to the prevailing temperature gradients, the positive temperature gradients continually reduce the width of the mushy zone in the solidifying sections and thereby promote effective interdendritic lateral feeding.

As soon as withdrawal of the article mold from the furnace 68 is commenced, it is preferred to have the flow of electrical energy to the furnace coils 90, 92 and 94 (FIG. 4) interrupted. However, the flow of current to the lower coil 94 may only be reduced as the mold 42 moves out of the furnace 68. The amount of electrical energy conducted to the coil 92 may be reduced to a lesser extent. The amount of electrical energy conducted to the coil 90 may be maintained greater than the amount of electrical energy conducted to the coil 92. Regardless of how the coils 90, 92 and 94 are energized, the metal in the pour cup 46 and runners 48 is maintained at least partially molten as the metal in the article molds 38 solidifies.

After the mold structure 42 has been completely withdrawn from the furnace 68, the mold structure and the metal therein is cooled and the ceramic material of the mold removed from the solidified metal. The metal which solidified in the article molds 38 will have an equiaxed grain structure and an overall configuration which corresponds to the configuration of the vane 10. Since there are no gates to supply molten metal to the article mold cavity 114 at locations along the longitudinal central axis of the article mold cavity, the long thin airfoil 16 of the cast vane 10 will be free of gating material. Of course, long thin metal articles other than the vane 10 could be cast with an equiaxed grain structure by using the foregoing method.

Furnace—Second Embodiment

Figure 4:
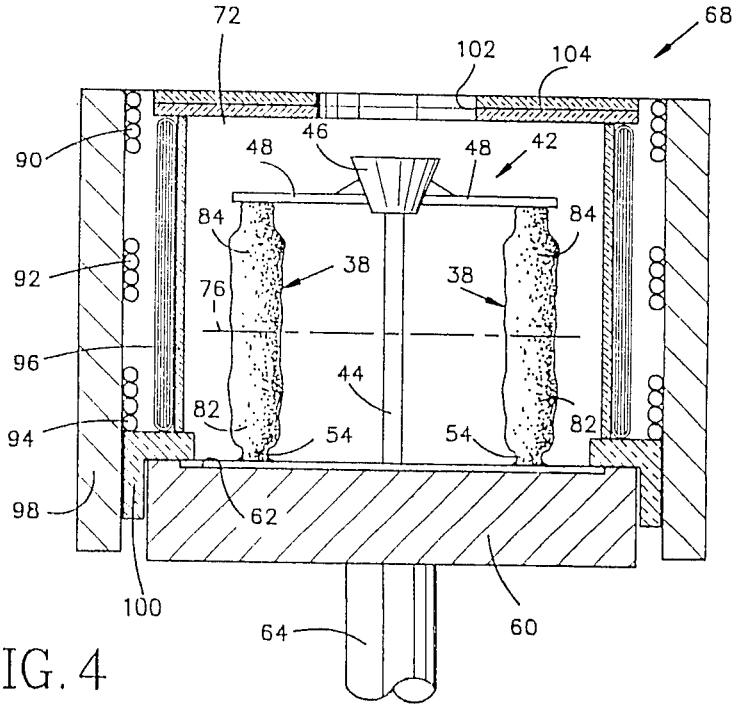
FIG. 4 is a schematic illustration of the manner in which a mold structure for casting a plurality of the articles of FIGS. 1 and 2 is supported on a chill plate in a furnace during preheating and pouring of molten metal into the mold structure.
Figure 8:
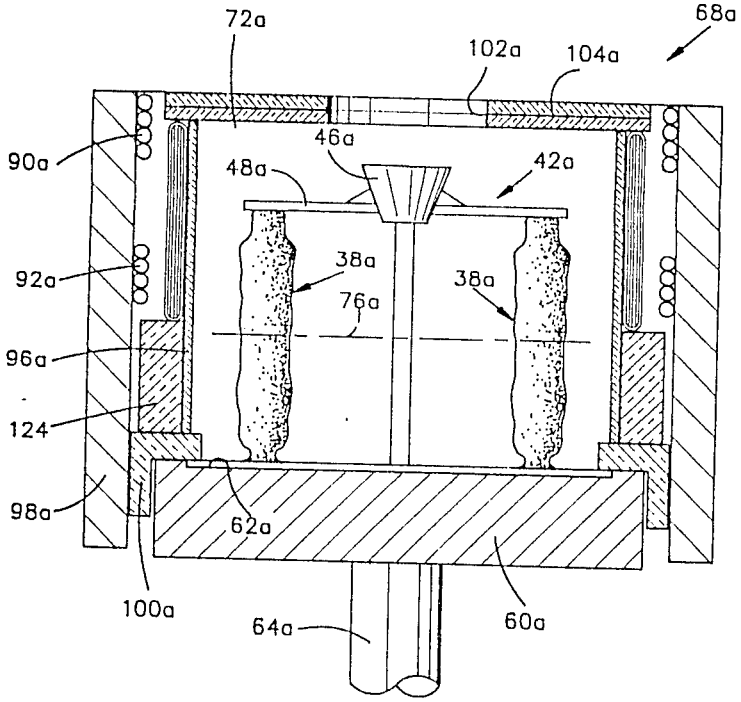
FIG. 8 is a sectional view, generally similar to FIG. 4, illustrating the construction of a second embodiment of the furnace.

The embodiment of the furnace 68 in FIG. 4 includes three coils 90, 92 and 94 to control the heating of the mold 42 and temperature gradients during withdrawal of the mold from the furnace. In the embodiment of the furnace illustrated in FIG. 8, only two coils are used. Since the embodiment of the furnace illustrated in FIG. 8 is generally similar to the embodiment of the furnace illustrated in FIG. 4, similar numerals will be utilized to designate similar components, the suffix letter "a" being associated with the numerals in FIG. 8 to avoid confusion.

A furnace **68*a* is used during the heating of a mold structure 42*a*. The furnace 68*a* has an upper coil 90*a* and a lower coil 92*a*. The susceptor 96*a* ends immediately below the lower coil 92*a*. A cylindrical ceramic spacer block 124 is provided below the coil 92*a*, in the position occupied by the coil 94 in the embodiment of the furnace illustrated in FIG. 4. Elimination of the lower coil and substituting a ceramic spacer block 124 makes it easier to heat the mold assembly 42*a* and obtain a temperature gradient which extends from the relatively cool lower half 82*a* of an article mold 38*a* to a relatively hot upper half 84*a*** of the article mold.

The omission of the lower coil, corresponding to the coil 94 of FIG. 4, results in the induction coils **90*a* and 92*a* circumscribing only about 50 of the length of the portion of the article mold 38*a* in which the article mold cavity is disposed. Thus, the coils 90*a* and 92*a* circumscribe only the portion of the mold structure 42*a* which is above the plane 76*a*. Therefore, less than 75% of the article mold cavity is surrounded by induction coils. The lower half of the article mold cavity is circumscribed by the annular ceramic spacer block 124**.

Casting A Nickel Chrome Superalloy Vane

The vane 10 of FIGS. 1 and 2 is advantageously formed of a nickel chrome superalloy, such as IN-713C or Rene 77 having a solidus temperature of more than 2,250° F. The article molds 38 are preheated so that the lower half 82 of the long thin portion of each article mold 38 has an average temperature of less than 2,250° F. The upper half 84 of the long thin portion of each article mold 38 is heated to an average temperature of more than 2,000° F. and less than 2,500° F. The molten nickel chrome superalloy is heated to a temperature above 2,400° F. before being poured.

In one specific instance, the vane 10 was formed of Rene 77 having a liquidus temperature of 2,450° F. and a solidus temperature of 2,310° F. The mold structure 42 was preheated so that the closed lower ends of the article molds 38 were at a temperature of approximately 1,850° F. and the upper ends of the article molds were at a temperature of approximately 2,250° F.

The molten Rene 77 was poured at a temperature of 2,650° F. The mold face coat contained 10% by weight of cobalt aluminate inoculant to promote nucleation. When the mold had been heated to have a temperature gradient which ranged from 1,850° F. at the lower ends of the long thin portions of the article molds 38 to 2,250° F. at the upper ends of the long thin portions of the article molds, the molten metal was poured into the pour cup 46.

The molten metal ran through the runners 48 into the article mold cavities 38. As the article molds 38 were filled with molten metal, it is believed that nucleation occurred at various locations along approximately 95% of the longitudinal extent of the long thin portion of the article mold cavity. As soon as the article mold cavities 38 were filled with molten metal, the chill plate 60 was lowered to begin withdrawal of the mold structure 42 from the furnace 68 at a rate of 60 inches per hour. As the mold structure 42 started to be withdrawn from the furnace 68, the electrical energy supplied to the coils 90, 92 and 94 was interrupted.

The vane 10 was cast without any gating along the longitudinal extent of the article mold cavity. The vane 10 had an equiaxed grain structure, similar to the grain structure shown in FIG. 3, and was free of defects. This specific vane had a grain size which was coarser than, but close to, an ASTM grain standard grain size No. 1. None of the surface grains had a maximum dimension of more than one fourth of an inch.

Conclusion

The present invention relates to a new and improved method of casting a metal article 10 which is long and thin or which has a long thin portion 16 and an equiaxed grain structure. The article 10 is cast in a mold cavity 14 having a configuration corresponding to the configuration of the article. The article mold cavity 114 is free of gating and risers between opposite ends of the long thin portion of the mold cavity. Thus, there are no gates or risers along the length of the long thin portion of the mold cavity 114.

The mold 42 is preheated so that a lower half 82 of the portion of the article mold 38 in which the long thin portion 16 of the vane or article 10 is cast is at a temperature which is close to but less than the solidus temperature of the metal of the article. The upper half 84 of the portion of the article mold 38 in which the long thin portion 16 of the article 10 is cast may be heated to a temperature which is either somewhat above or below the solidus temperature of the metal of the article to be cast. Molten metal is conducted into the article mold cavity 114 through an inlet from a gate or runner 48 at the upper end of the article mold cavity and is solidified with an equiaxed grain structure (FIG. 3). If desired, a second gate could be provided at the lower end or the article mold cavity.

During and immediately after pouring, the molten metal is simultaneously solidified along at least fifty percent of the surface area 112 of the lower half of the portion of the article mold cavity 114 in which the long thin portion 16 of the article 10 is cast and along at least fifty percent of the surface area 112 of the upper half of the portion of the article mold cavity in which the long thin portion of the article is cast. The molten metal in the lower half of the portion of the article mold cavity 114 in which the long thin portion of the article is cast is completely solidified before the molten metal in the upper half of this portion of article mold cavity is completely solidified. During solidification of the molten metal with an equiaxed grain structure, shrinkage is compensated for by feeding metal to the long thin portion of the article mold cavity 114 through the inlet through which molten metal was originally conducted to the long thin portion of the article mold cavity.

Having described specific preferred embodiments of the invention, the following is claimed:

1. A method of casting a metal article at least a portion of which is long and thin and has a length which is more than four inches and which is at least twenty times its thickness, said method comprising the steps of forming a mold having an article mold cavity with a long thin portion which has a length which is more than four inches and is at least twenty times its thickness, the long thin portion of the article mold cavity being free of gating along its length, positioning the mold in a furnace with a longitudinal axis of the long thin portion of the article mold cavity in an upright orientation, heating the mold, said step of heating the mold including heating a lower half of the portion of the mold defining the long thin portion of the article mold cavity into a first temperature range, the highest temperature of the first temperature range being close to but less than the solidus temperature of the metal of the article, said step of heating the mold including heating an upper half of the portion of the mold defining the long thin portion of the article mold cavity into a second temperature range containing temperatures which are greater than the first temperature range, conducting molten metal into the article mold cavity, said step of conducting molten metal into the article mold cavity including conducting molten metal into the long thin portion of the article mold cavity at a location other than along the length of the long thin portion of the article mold cavity, said step of conducting molten metal into the article mold cavity being initiated while the lower half of the portion of the mold defining the long thin portion of the article mold cavity is in the first temperature range and the upper half of the portion of the mold defining the long thin portion of the article mold cavity is in the second temperature range, and solidifying the molten metal in the article mold cavity with an equiaxed grain structure.

2. A method as set forth in claim 1 wherein said step of solidifying the molten metal in the article mold cavity includes simultaneously solidifying molten metal along at least 50 percent of the surface area of the article mold cavity disposed in the lower half of the portion of the mold defining the long thin portion of the article mold cavity and along at least 50 percent of the surface area of the article mold cavity disposed in the upper half of the portion of the mold defining the long this portion of the article mold cavity, and completing solidification of the molten metal in the portion of the article mold cavity disposed in the lower half of the portion of the mold defining the long thin portion of the article mold cavity prior to completion of solidification of the molten metal in the portion of the article mold cavity disposed in the upper half of the portion of the mold defining the long thin portion of the article mold cavity.

3. A method as set forth in claim 2 wherein said step of completing solidification of the molten metal in the lower half of the portion of the mold defining the long thin portion of the article mold cavity is performed at a time when a major portion of the molten metal in the upper half of the portion of the mold defining the long thin portion of the article mold cavity has already solidified.

4. A method as set forth in claim 2 wherein said steps of solidifying molten metal along the surface area of the mold cavity and completing solidification of the molten metal include withdrawing the entire portion of the mold defining the long thin portion of the article mold cavity from the furnace into a vacuum at a rate which is at least 60 inches per hour.

5. A method as set forth in claim 1 wherein the metal article is formed of a nickel chrome superalloy having a solidus temperature of more than 2,250° F., said step of conducting molten metal into the article mold cavity including conducting a molten nickel chrome superalloy at a temperature of more than 2,500° F. into the article mold cavity, said step of heating a lower half of the portion of the mold defining the long thin portion of the article mold cavity including heating the lower half of the portion of the mold defining the long thin portion of the article mold cavity to an average temperature of less than 2,250° F.

6. A method as set forth in claim 1 wherein the long thin portion of the metal article included an airfoil having a thickness of less than 0.25 inches.

7. A method as set forth in claim 1 wherein said step of heating the mold includes heating the mold in an induction furnace having a coil which circumscribes less than 75% of the length of the portion of the mold defining the long thin portion of the article mold cavity.

8. A method as set forth in claim 1 wherein said step of heating the mold includes transmitting energy to the mold to heat the mold, at least 75% of the energy transmitted to the mold being transmitted to the upper half of the portion of the mold defining the long thin portion of the article mold cavity.

9. A method as set forth in claim 1 wherein said step of conducting molten metal into the article mold cavity includes conducting molten metal into the long thin portion of the article mold cavity at only one end of the long thin portion of the article mold cavity.

10. A method of casting a metal article at least a portion of which is long and thin and has a length which is more than four inches and which is at least twenty times its thickness, said method comprising the steps of forming a mold having an article mold cavity with a long thin portion having a length which is more than four inches and is at least twenty times its thickness, the long thin portion of the article mold cavity being free of gating along its length, positioning the mold in a furnace with a longitudinal axis of the long thin portion of the article mold in an upright orientation, heating the mold, conducting molten metal into the article mold cavity, said step of conducting molten metal into the article mold cavity including conducting molten metal into the long thin portion of the article mold cavity at a location other than along the length of the long thin portion of the article mold cavity, solidifying the molten metal in the article mold cavity with an equiaxed grain structure, and completing solidification of the molten metal in a lower half of the long thin portion of the article mold cavity prior to completion of solidification of the molten metal in an upper half of the long thin portion of the article mold cavity and after a major portion of the molten metal in the upper half of the long thin portion of the article mold cavity has solidified.

11. A method as set forth in claim 10 wherein said step of heating the mold includes heating the lower half of the portion of the mold defining the long thin portion of the article mold cavity into a first temperature range having an average temperature of less than 2,250° F., the highest temperature in the first temperature range being close to but less than the solidus temperature of the metal of the article, said step of heating the mold including heating the upper half of the portion of the mold defining the long thin portion of the article mold cavity into a second temperature range containing temperatures which are greater than the first temperature range and having an average temperature of less than 2,500° F., said step of conducting molten metal into the article mold cavity including conducting molten metal into the article mold with the metal at a temperature above 2,400° F.

12. A method as set forth in claim 10 wherein said step of solidifying the molten metal includes initiating solidification of the molten metal over a large majority of the surface area of the long thin portion of the article mold cavity.

13. A method as set forth in claim 10 wherein said step of solidifying molten metal in the article mold cavity includes simultaneously solidifying molten metal along at least 50 percent of the surface area of the article mold cavity disposed in the lower half of the portion of the mold defining the long thin portion of the article mold cavity and along at least 50 percent of the surface area of the article mold cavity disposed in the upper half of the portion of the mold defining the long thin portion of the article mold cavity.

14. A method as set forth in claim 10 wherein said step of solidifying the molten metal includes forming a thin layer of equiaxed metal over a large majority of the surface area of the mold cavity defining the long thin portion of the article mold cavity and, thereafter, growing dendrites inwardly and upwardly from the thin skin extending over the large majority of the surface area of the mold cavity defining the long thin portion of the article mold cavity.

15. A method as set forth in claim 14 wherein said step of growing dendrites inwardly and upwardly from the thin skin includes growing dendrites upwardly from the thin skin at a greater rate than dendrites are grown inwardly from the thin skin.

* * * * *

UNITED STATES PATENT AND TRADEMARK OFFICE

CERTIFICATE OF CORRECTION

PATENT NO. : 4,809,764

DATED : March 7, 1989

INVENTOR(S) : T.V. Rama Prasad

It is certified that error appears in the above-identified patent and that said Letters Patent is hereby corrected as shown below:

Column 2, Line 30, insert "a new" after the word --provide--.

Column 2, Line 32, insert "without" after the word --structure--.

Signed and Sealed this

Twenty-first Day of November, 1989

*Attest:*

JEFFREY M. SAMUELS

*Attesting Officer* *Acting Commissioner of Patents and Trademarks*